US010492559B1

(12) United States Patent
Kele et al.

(10) Patent No.: US 10,492,559 B1
(45) Date of Patent: Dec. 3, 2019

(54) HELMET WITH REMOVABLE CHIN BAR

(71) Applicant: Bell Sports, Inc., Scotts Valley, CA (US)

(72) Inventors: Paul A. Kele, Soquel, CA (US); David M. Thompson, Ben Lomond, CA (US)

(73) Assignee: Bell Sports, Inc., Scotts Valley, CA (US)

( * ) Notice: Subject to any disclaimer, the term of this patent is extended or adjusted under 35 U.S.C. 154(b) by 121 days.

(21) Appl. No.: 15/702,300

(22) Filed: Sep. 12, 2017

Related U.S. Application Data

(60) Provisional application No. 62/393,540, filed on Sep. 12, 2016.

(51) Int. Cl.
*A42B 3/32* (2006.01)

(52) U.S. Cl.
CPC ..... *A42B 3/326* (2013.01)

(58) Field of Classification Search
CPC .. A42B 3/326; A42B 3/32; A42B 3/20; A42B 3/205; A42B 3/04; A42B 3/00
USPC ..... 2/424, 410, 6.1, 6.2
See application file for complete search history.

(56) References Cited

U.S. PATENT DOCUMENTS 4,769,857 A * 9/1988 Cianfanelli ..... A42B 3/326 2/421
9,060,557 B2 * 6/2015 Maier ..... A42B 3/326
2012/0317706 A1 * 12/2012 Lebel ..... F41H 1/08 2/422
2015/0135417 A1 * 5/2015 Lebel ..... A42B 3/326 2/424
2015/0245682 A1 * 9/2015 McGinn ..... A42B 3/221 2/422

FOREIGN PATENT DOCUMENTS

WO 2013097943 A 7/2013

* cited by examiner

*Primary Examiner* — Alissa J Tompkins
*Assistant Examiner* — F Griffin Hall
(74) *Attorney, Agent, or Firm* — Booth Udall Fuller, PLC

(57) ABSTRACT

A helmet comprising a helmet body and a chin bar is disclosed. The helmet body comprises an opening and two attachment anchors located opposite each other proximate a leading edge of the opening. Each attachment anchor comprises a pivot socket and a lock support. The chin bar comprises two opposing ends, each releasably coupled to a different attachment anchor. Each end of the chin bar comprises a locking mechanism engaged with a lock support of a different attachment anchor, and a pivot arm releasably and pivotally coupled to the pivot socket of the different attachment anchor. The chin bar is pivotable between a first angle and a second angle with respect to the helmet body, and the pivot arms are releasable from the pivot sockets of the helmet body while the locking mechanisms of the chin bar are disengaged from the lock supports of the helmet body.

16 Claims, 9 Drawing Sheets

HELMET WITH REMOVABLE CHIN BAR

RELATED APPLICATIONS

This application claims the benefit of U.S. provisional patent application 62/393,540, filed Sep. 12, 2016 titled "Helmet with Removable Chin Bar," the entirety of the disclosure of which is hereby incorporated by this reference.

TECHNICAL FIELD

Aspects of this document relate generally to helmets with removable chin bars.

BACKGROUND

The needs of a rider participating in a mountain biking trek or race will sometimes change during the ride. During a climb, the rider is ascending a trail with great exertion; a helmet providing unobstructed breathing, ventilation and comfort is desirable. During a descent, the rider needs greater protection as they speed downhill. Conventional helmets have struggled to handle both scenarios well. Conventional helmets with chin bars are built to provide protection to downhill riders, but are not ideal for ascending. The chin bar may obstruct ventilation and breathing, and the added protection increases the weight of the helmet on the wearer's head. Furthermore, a conventional helmet that would be comfortable during a climb may not provide sufficient protection against the high-speed impacts that can happen during a descent. Conventional helmets leave riders with a choice between the inconvenience of carrying two helmets on a ride, an uncomfortable climb, or a dangerous descent.

SUMMARY

According to one aspect, a helmet may comprise a helmet body comprising an opening and two attachment anchors located opposite each other proximate a leading edge of the opening, each attachment anchor comprising a pivot socket and a lock support, and a chin bar removably coupled to the helmet body, the chin bar comprising two opposing ends, each end releasably coupled to a different one of the two attachment anchors and comprising a locking mechanism engaged with the lock support of the different one of the two attachment anchors and a pivot arm releasably and pivotally coupled to the pivot socket of the different one of the two attachment anchors, wherein the chin bar is pivotable between a first angle and a second angle with respect to the helmet body, and the pivot arms are releasable from the pivot sockets of the helmet body, only while the locking mechanisms of the chin bar are disengaged from the lock supports of the helmet body.

Particular embodiments may comprise one or more of the following features. Each locking mechanism of the chin bar may comprise a biased latch arm having a barbed end, the barbed end having a front and a back, at least one of the front of each barbed end and the lock support of each of the two attachment anchors is sloped such that when the front is pressed against the lock support, the latch arm is deflected contrary to a bias, to allow the barbed end past the lock support such that the back may engage with the lock support. Each locking mechanism may further comprise a release button configured to move the latch arm of the locking mechanism against the bias sufficient to disengage the back of the barbed end from the lock support. Each pivot arm of the chin bar may comprise a pivot button having a stem and a head wider than the stem, wherein the pivot socket of each of the two attachment anchors of the helmet body comprises a reentrant slot having an open end wider than a closed end, the open end proximate the leading edge of the opening of the helmet body, and the closed end sized to receive the stem of the pivot button while being smaller than the head of the pivot button. The pivot arm may be releasably and pivotally coupled to the pivot socket when the stem of the pivot button is inside the closed end of the reentrant slot of the pivot socket. The two opposing ends of the chin bar each may further comprise at least one tab configured to mate with a portion of the adjacent attachment anchor while the chin bar is coupled to the helmet body. The helmet body may comprise an outer surface having at least one tactile guide on the outer surface proximate each pivot socket of the helmet body. The two attachment anchors may be integral with an outer shell of the helmet body. The two attachment anchors may be in-molded into an energy-absorbing material of the helmet body. The helmet body comprises an outer surface, the chin bar comprises an outer surface, and the outer surface of the helmet body may be flush with the outer surface of the chin bar proximate the two attachment anchors. For each of the two attachment anchors, the leading edge of the opening proximate the attachment anchor may be in fluid communication with an interior cavity of the helmet body through the attachment anchor.

According to an aspect, a helmet may comprise a helmet body comprising an opening and two attachment anchors located opposite each other proximate a leading edge of the opening, each attachment anchor comprising a pivot socket and a lock support, and a chin bar removably coupled to the helmet body, the chin bar comprising two opposing ends, each end releasably coupled to a different one of the two attachment anchors and comprising a locking mechanism engaged with the lock support of the different one of the two attachment anchors and a pivot arm releasably and pivotally coupled to the pivot socket of the different one of the two attachment anchor, wherein the chin bar is pivotable between a first angle and a second angle with respect to the helmet body, and the pivot arms are releasable from the pivot sockets of the helmet body, only while the locking mechanisms of the chin bar are disengaged from the lock supports of the helmet body and the chin bar is oriented at approximately the first angle with respect to the helmet body, wherein each locking mechanism of the chin bar comprises a biased latch arm having a barbed end, the barbed end having a front and a back, at least one of the front and the lock support of each of the two attachment anchors is sloped such that when the front is pressed against the lock support, the latch arm is deflected contrary to a bias, to allow the barbed end past the lock support such that the back may engage with the lock support, and wherein each locking mechanism further comprises a release button configured to move the latch arm of the locking mechanism against the bias sufficient to disengage the back of the barbed end from the lock support, and wherein each pivot arm of the chin bar comprises a pivot button having a stem and a head wider than the stem, wherein the pivot socket of each of the two attachment anchors of the helmet body comprises a reentrant slot having an open end wider than a closed end, the open end proximate the leading edge of the opening of the helmet body and facing away from the lock support of the same attachment anchor at an angle with respect to the helmet body that is approximately equal to the first angle, and the closed end sized to receive the stem of the pivot button while being smaller than the head of the pivot button, and wherein the pivot arm is releasably and pivotally coupled to the pivot socket when the stem of the pivot button is inside the closed end of the reentrant slot of the pivot socket.

Particular embodiments may comprise one or more of the following features. The two opposing ends of the chin bar may each further comprise at least one tab configured to mate with a portion of the adjacent attachment anchor while the chin bar is coupled to the helmet body. The helmet body may comprise an outer surface having at least one tactile guide on the outer surface proximate each pivot socket of the helmet body. The two attachment anchors may be integral with an outer shell of the helmet body. The helmet body may further comprise an outer surface, the chin bar comprises an outer surface, and the outer surface of the helmet body is flush with the outer surface of the chin bar proximate the two attachment anchors. For each of the two attachment anchors, the leading edge of the opening proximate the attachment anchor may be in fluid communication with an interior cavity of the helmet body through the attachment anchor. The pivot arms and locking mechanisms of the chin bar and the pivot sockets and lock supports of the helmet body may be positioned such that when the pivot arms of the chin bar are pivotally coupled to the pivot sockets of the helmet body, each locking mechanism of the chin bar is aligned with a different one of the two lock supports of the helmet body. Each end of the chin bar may further comprise a leading edge that is mated with the leading edge of the opening of the helmet body when the chin bar is removably coupled to the helmet body through the pivot arms and locking mechanisms of the chin bar.

According to an aspect, a method for securing a chin bar to a helmet body may comprise aligning the chin bar comprising two opposing ends, each end having a pivot arm and a locking mechanism, with the helmet body comprising an opening and two attachment anchors located opposite each other proximate a leading edge of the opening, such that the chin bar is at a first angle with respect to the helmet body, pivotally coupling each pivot arm of the chin bar with a pivot socket of a different one of the two attachment anchors of the helmet body, and pivoting the chin bar with respect to the helmet body until the chin bar is at a second angle with respect to the helmet body and each locking mechanism of the chin bar has engaged with a lock support of a different one of the two attachment anchors of the helmet body.

Particular embodiments may comprise one or more of the following. Aligning the chin bar with the helmet body may comprise positioning an end of each pivot arm of the chin bar proximate an open end of a reentrant slot of a different one of the two pivot sockets of the helmet body, the end of each pivot arm comprising a pivot button having a stem and a head wider than the stem. Pivotally coupling each pivot arm with the pivot socket of the different one of the two attachment anchors comprises inserting the pivot button of each pivot arm into the nearby open end of the reentrant slot of the pivot socket until the stem of the pivot button engages with a closed end of the reentrant slot sized to receive the stem while being smaller than the head, the open end facing away from the lock support of the same attachment anchor at an angle with respect to the helmet body that is approximately equal to the first angle. Pivoting the chin bar with respect to the helmet body may comprise pivoting the chin bar about the stems of the pivot buttons while each stem is pivotally coupled with the closed end of a different one of the two reentrant slots of the helmet body. Each locking mechanism of the chin bar may comprise a biased latch arm having a barbed end, the barbed end having a front and a back, wherein at least one of the front of each barbed end and the lock support of each of the two attachment anchors is sloped such that when the front is pressed against the lock support as the chin bar is pivoted with respect to the helmet body towards the second angle, the latch arm is deflected contrary to a bias, to allow the barbed end past the lock support such that when the chin bar is at the second angle with respect to the helmet body the back may engage with the lock support.

Aspects and applications of the disclosure presented here are described below in the drawings and detailed description. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112,116. Thus, the use of the words "function," "means" or "step" in the Detailed Description or Description of the Drawings or claims is not intended to somehow indicate a desire to invoke the special provisions of 35 U.S.C. § 112, 116, to define the invention. To the contrary, if the provisions of 35 U.S.C. § 112, 116 are sought to be invoked to define the inventions, the claims will specifically and expressly state the exact phrases "means for" or "step for", and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. § 112, 116. Moreover, even if the provisions of 35 U.S.C. § 112, ¶6 are invoked to define the claimed aspects, it is intended that these aspects not be limited only to the specific structure, material or acts that are described in the preferred embodiments, but in addition, include any and all structures, materials or acts that perform the claimed function as described in alternative embodiments or forms of the disclosure, or that are well known present or later-developed, equivalent structures, material or acts for performing the claimed function.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

The invention will hereinafter be described in conjunction with the appended drawings, where like designations denote like elements, and.

DETAILED DESCRIPTION

Figure 1:
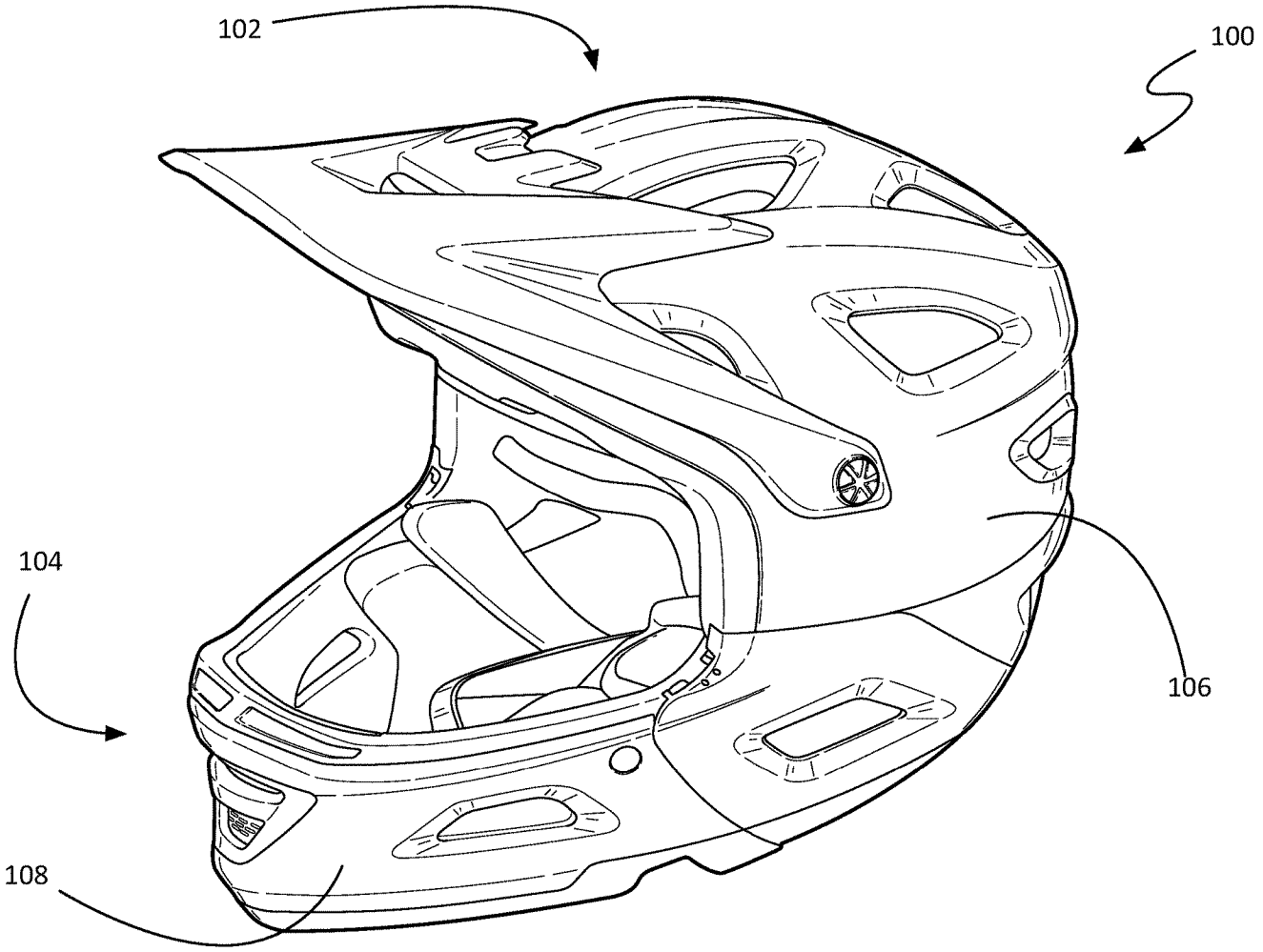
FIG. 1 is a perspective view of a helmet comprising a helmet body and a removable chin bar.

This disclosure, its aspects and implementations, are not limited to the specific material types, components, methods, or other examples disclosed herein. Many additional material types, components, methods, and procedures known in the art are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of embodiments in many different forms, there is shown in the drawings and will herein be described in detail particular embodiments with the understanding that the present disclosure is to be considered as an exemplification of the principles of the disclosed methods and systems, and is not intended to limit the broad aspect of the disclosed concepts to the embodiments illustrated.

A mountain biker will often have different needs and priorities, depending on what phase of the trek or race they are in. During a climbing phase, a rider is ascending with great exertion, and has need of ventilation and unobstructed breathing. Since ascension speeds are slow, protection against high-speed impact is not as high a priority. During a descent phase, the rider needs protection against high-energy impacts as they speed downhill. Conventional helmets have struggled to handle both scenarios well. Conventional helmets with chin bars are built to provide protection to downhill riders, but are not ideal for ascending. The chin bar may obstruct ventilation and breathing, and the added protection increases the weight. For conventional downhill helmets with removable chin bars, the connecting mechanisms are generally located in the helmet portion to couple to the removable chin bar, leaving the heavy mechanisms located in the helmet even when the chin bar is removed.

Contemplated in this disclosure is a helmet with a removable chin bar, where the bulk of the connecting hardware is contained in the removable chin bar. Locating most of the connecting hardware in the chin bar rather than the helmet body reduces the weight of the helmet body when the chin bar is not attached. Additionally, the attachment anchors in the helmet body may be configured to channel air over the rider's ears when the chin bar is not attached. Multiple connectors located in the chin bar may increase the protection provided by distributing the load of an impact across the entire interface, without increasing the weight of the helmet. Moreover, the chin bar may install easily and quickly by pivoting into place. In use, a rider may spend the climb portion of their ride with the chin bar removed, reducing the weight on their head and neck, and improving comfort, cooling, and ventilation. Before beginning a downhill portion of the ride, the rider can quickly attach the chin bar without having to remove the helmet. Once attached, the chin bar provides protection from the increased danger associated with a downhill ride. Afterwards, the chin bar is again easily removed. A rider may climb in comfort, and then quickly install a chin bar in preparation for a thrilling but risky downhill ride.

Figure 2:
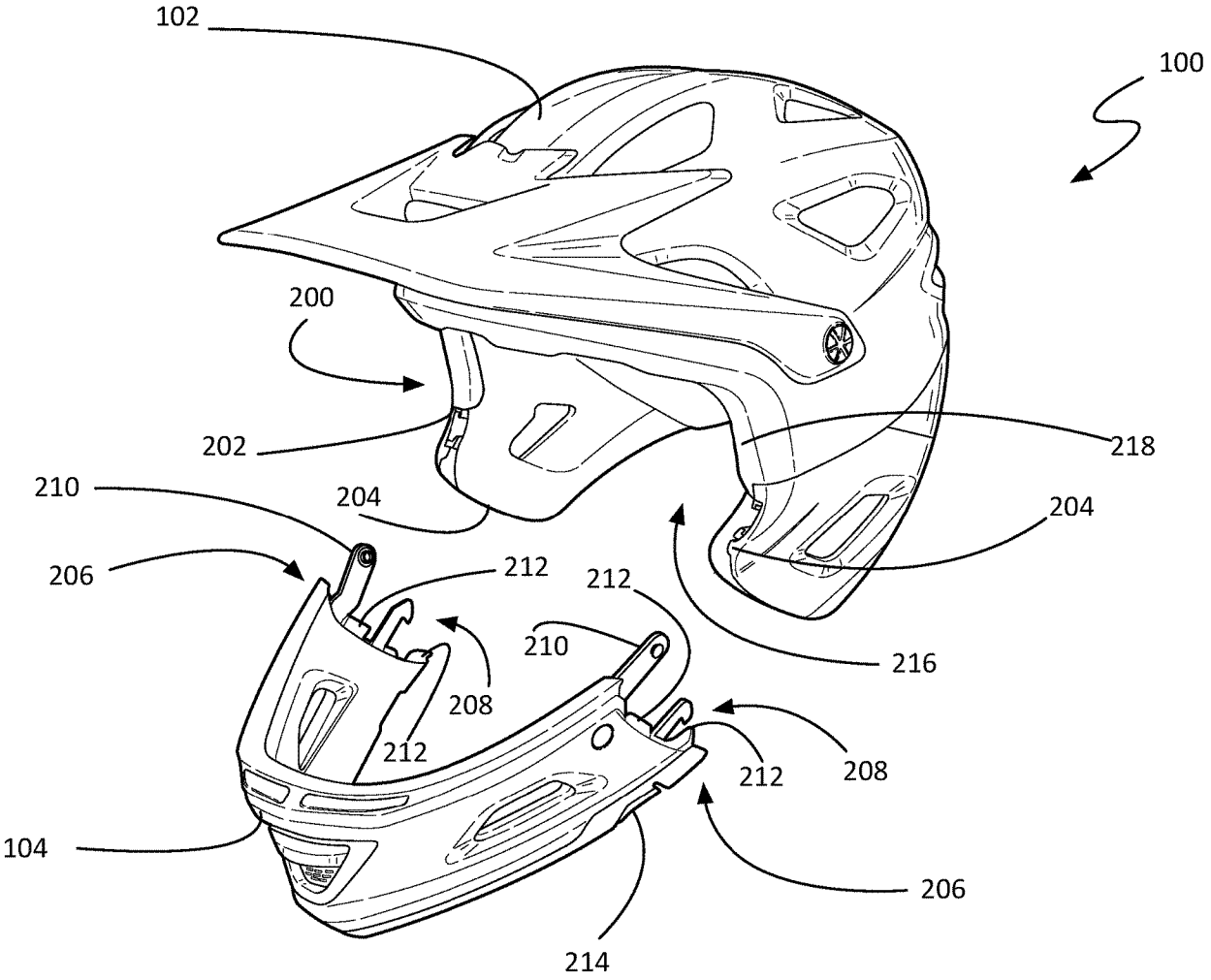
FIG. 2 is a perspective view of a helmet having a detached chin bar.

FIGS. 1 and 2 depict a perspective view of a non-limiting embodiment of a helmet 100 having a helmet body 102 and a removable chin bar 104. FIG. 1 depicts the chin bar 104 coupled to the helmet body 102, while FIG. 2 shows the chin bar 104 separated from the helmet body 102. It should be noted that for more clear viewing of the removable chin bar components, FIG. 2 does not depict any internal comfort padding. As shown, the helmet body 102 comprises an opening 200 for the rider's face; the perimeter of the opening 200 has a leading edge 202. According to various embodiments, the helmet body 102 comprises two attachment anchors 204 located opposite each other on, or near, the leading edge 202.

In the context of the present description and the claims that follow, an attachment anchor 204 is a structure to which a chin bar 104 securely, yet releasably, couples. The attachment anchors 204 may be composed of a variety of materials that are strong, yet light, including metals and plastics. In some embodiments, including the non-limiting example shown in FIGS. 1 and 2, the attachment anchors 204 of a helmet body 102 may be positioned and shaped such that when coupled to a chin bar 104, the outer surface 106 of the helmet body 102 is flush with the outer surface 108 of the chin bar proximate the interface between the two.

In some embodiments, the attachment anchors 204 may be in-molded into an energy-absorbing material 218 inside the helmet body 102. In other embodiments, the attachment anchors 204 may be coupled to other structures within the helmet. For example, in some embodiments, the attachment anchors 204 may be integrated with an outer shell. See, for example, outer shell 420 of FIG. 4. In still other embodiments, the attachment anchors 204 may be coupled to each other. For example, a band of strong material may connect the two attachment anchors 204 around the back of the helmet body 102. As an option, this may be done in addition to being molded directly into the helmet body 102, to help resist having the anchors 204 pulled out.

According to various embodiments, the attachment anchors 204 may be sized with, and located proximate to, the ear covers of a helmet body 102. This may be advantageous in event of an impact while the chin bar 104 is attached. Allowing the ear covers to bend outward may further attenuate the force of the impact. The engagement of the attachments anchor 204 by the connectors of the chin bar 104 at multiple points may serve to distribute the load of the impact across the entire ear cover.

The removable chin bar 104 comprises two opposing ends 206, each end having one or more connectors to interface with the helmet body 102. As shown in FIG. 2, each end of the chin bar 104 has a pivot arm 210 and a locking mechanism 208, both configured to interface with an attachment anchor 204 of the helmet body 102. Additionally, each end 206 of the chin bar 104 may comprise one or more tabs 212, as well as a release button 214 associated with one or both locking mechanisms 208. The pivot arm 210, locking mechanism 208, tab 212, and release button 214 will all be discussed in greater detail with respect to FIG. 3.

As seen in FIGS. 1 and 2, the removable chin bar 104 attaches to the helmet body 102 along the leading edge 202 of the ear covers, near the cheeks of the helmet wearer, according to various embodiments. This advantageously allows a user to visually guide the installation process, rather than relying solely on touch, or having to remove the helmet 100 altogether. In other embodiments, the chin bar 104 may attach to the helmet body 102 in a different location. For example, in embodiments using helmets bodies 102 with removable ear covers, the chin bar 104 may comprise integrated ear covers, and may attach to the helmet body 102 behind the wearer's ears. This would result in a lighter, more ventilated helmet body for a comfortable ascent phase, but possibly at the cost of quick conversion.

When a chin bar 104 is not attached, the attachment anchors 204 may serve other purposes. According to various embodiments, the attachment anchors 204, when not engaged with a chin bar 104, may be configured with air channels through the openings at the attachment anchors and into the interior cavity 216 of the helmet 100, to channel air from the front of the helmet 100 into the interior cavity 216 of the helmet 100, over the rider's ears, and out the back of the helmet 100, providing improved ventilation and cooling.

The non-limiting embodiments and use cases discussed and depicted in this disclosure are directed to a mountain biking helmet. However, it should be understood that as used herein, a helmet body 102 may comprise any helmet body type known in the art that can configured to couple with a removable chin bar 104. For example, a helmet 100 may comprise a motorcycle, mountain biking, or any other helmet wherein a chin bar may be desirable for the wearer in some circumstances, and not in others. The helmet body 100 may include any shells, layers, accessories (e.g. visors, mounts, etc.), energy management material, and the like known in the art for helmets. The chin bar 104 may likewise comprise any materials known in the art for chin bars.

Figure 3:
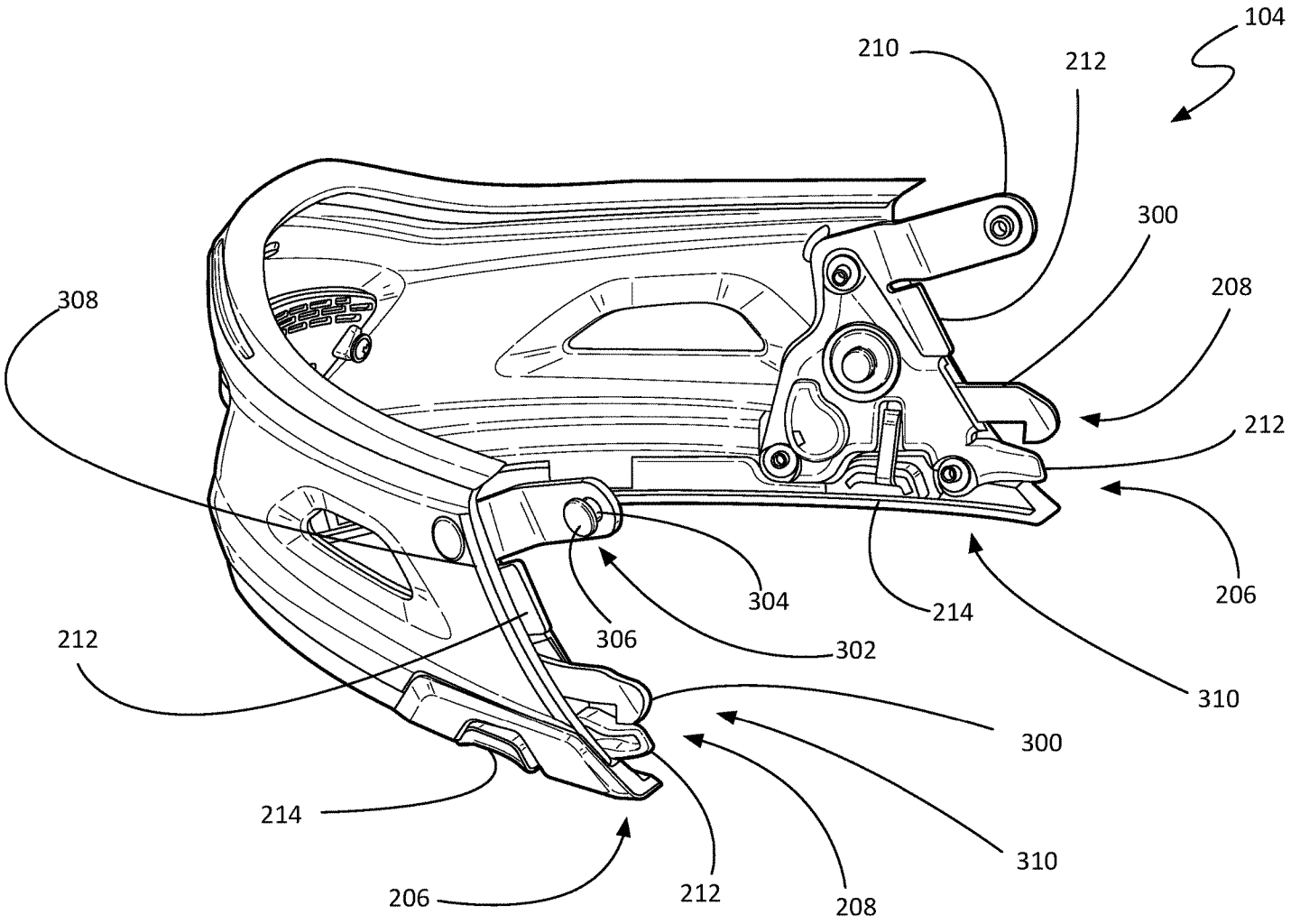
FIG. 3 is a perspective view of a removable chin bar.

FIG. 3 depicts a perspective view of a non-limiting embodiment of a removable chin bar 104. It should be noted that FIG. 3 does not depict some of the internal surfaces (compare, for example, with the chin bar 104 of FIG. 2) nor any comfort padding, to provide a clear depiction of various internal of this particular embodiment of a removable chin bar 104. As discussed above, the bulk of the connection hardware is located in the chin bar 104 portion of the helmet 100, reducing the weight of the helmet body 102 portion of the helmet 100.

As shown, the chin bar 104 comprises two connectors 310, according to various embodiments, with a connector 310 at each end 206 of the chin bar 104. As shown in FIG. 3, each connector 310 comprises a pivot arm 210, a locking mechanism 208, and two tabs 212. In other embodiments, the connector 310 may comprise more or fewer elements. For example, in one embodiment, each connector 310 may comprise an additional tab 212.

In various embodiments, the connector 310 may be constructed out of strong materials such as metal, thermoplastic, and other rigid, durable materials. In a specific embodiment, the connector 310 may be made of stainless steel. In some embodiments, the elements of the connector 310 may comprise different materials. For example, in one embodiment, the pivot arm 210, a middle tab 212, and the locking mechanism 208 may be stainless steel, while a lower tab 212 may be plastic. Those skilled in the art will recognize that the connectors 310 may be adapted to other designs and types of chin bars 104, beyond the specific design shown in FIG. 3.

In the context of the present description and the claims that follow, a locking mechanism 208 refers to a mechanism configured to secure the chin bar 104 to the helmet body 102 and prevent unintentional separation. In various embodiments, the locking mechanism 208 may be operated through some sort of release, such as a release button 214. The chin bar 104 comprises a locking mechanism 208 in each end. In some embodiments, including the non-limiting example shown in FIG. 3, each locking mechanism 208 may be operated by its own release (e.g. release button 214). In other embodiments, the chin bar 104 may comprise a single release that operates both locking mechanisms 208.

According to various embodiments, the locking mechanism 208 may comprise a biased latch arm 300. As shown in FIG. 3, the biased latch arm 300 may be hook shaped, and configured to couple with a structure within an attachment anchor 204. See, for example, the lock support 402 in FIG. 4. The interaction between the biased latch arm 300 and an attachment anchor 204 will be discussed in greater detail with respect to FIG. 4.

The biased latch arm 300 may be linearly or pivotally displaced against a bias by pressing the release button 214. In other embodiments, a latching arm may be operated with other types of movement. For example, in one embodiment, the latching arm may be "key shaped", and may be twisted or rotated after entering a locking socket of an attachment anchor 204 to secure the chin bar 104 to the helmet body 102.

As shown in FIG. 3, each pivot arm 210 comprises a pivot button 302 proximate the end of the pivot arm 210. A pivot button 302 provides a structure which engages with an attachment anchor 204 of a helmet body 102, and upon which the chin bar 104 can pivot with respect to the helmet body 102. According to various embodiments, the pivot button 302 may comprise a head 306 that is coupled to the pivot arm 210 by a stem 304, the stem 304 being narrower than the head 306, as shown in FIG. 3. The interaction between the pivot arm 210 and the attachment anchor 204 of the helmet body 102 will be discussed further with respect to FIG. 5.

According to various embodiments, the pivot arm 210 may serve as the initial point of contact and attachment between the chin bar 104 and the helmet body 102. Once the pivot arms 210 have been engaged with an attachment anchors 204 of a helmet body 102, the chin bar 104 pivots downwards and the remaining elements of the connectors 310 are aligned with and subsequently engage with the attachment anchors 204, according to some embodiments.

The connectors 310 of the non-limiting example of a chin bar 104 shown in FIG. 3 each include two tabs 212, which may serve to provide additional stability and strength to the connection between the chin bar 104 and a helmet body 102. In event of an impact, these tabs 212 may serve to distribute the forces applied to the chin bar 104 across more of the leading edge 202 of the helmet body 102, according to various embodiments. In some embodiments, each connector 310 of the chin bar 104 may comprise one or more tabs 212, while other embodiments may not employ tabs 212 at all. The tabs 212 may be positioned, and the attachment anchors 204 of the helmet body 102 shaped, such that the tabs 212 mate with the attachment anchors 204 when the chin bar 104 is coupled to the helmet body 102. In this way, the forces of an impact may be transferred from the chin bar 104 to the helmet body 102 through more than just the leading edge 308 of the chin bar 104 mating with the leading edge 202 of the helmet body 102, but also through reinforced elements internal to the chin bar 104, such as the tabs 212, pivot arms 210, and the like.

Figure 4:
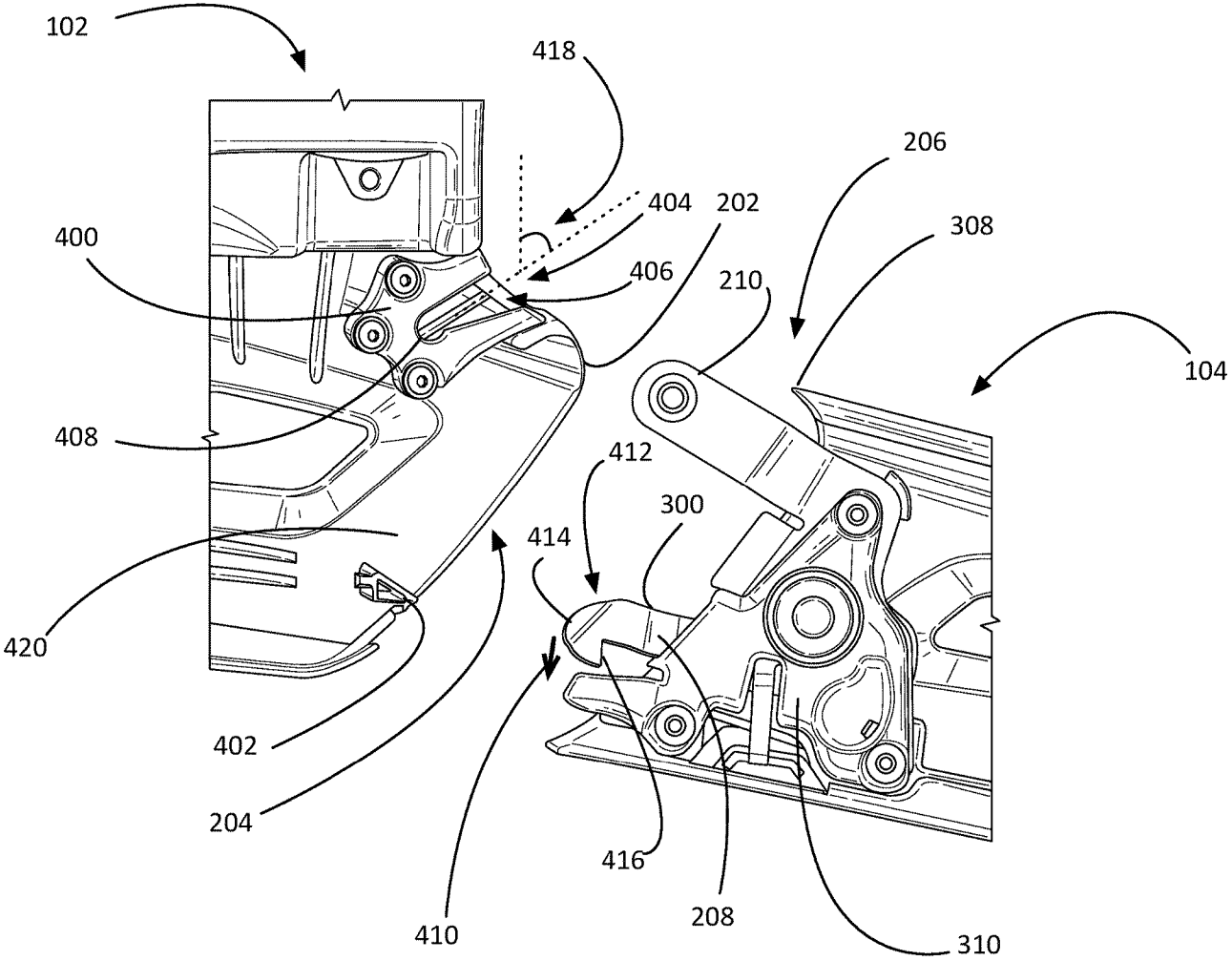
FIG. 4 is a close-up view of an end of a chin bar and an attachment anchor of a helmet body.

FIG. 4 shows a close-up, internal partial view of a non-limiting embodiment of the attachment anchor 204 of a helmet body 102 and a connector 310 of a chin bar 104. It should be noted that FIG. 4 does not include some of the interior surfaces of the helmet body 102 or chin bar 104, nor does it include any comfort padding, to better demonstrate the structure and operation of the attachment anchor 204 and connector 310.

The attachment anchor 204 comprises structures to interface with a connector 310 of a removable chin bar 104, securing it to the helmet body 102. Advantageous over conventional helmets with removable chin bars, the attachment anchors 204 of the helmet body 102 contemplated herein minimize the weight of the helmet body 102 by relying on hardware contained within the removable chin bar 104, as previously discussed. As seen in the non-limiting example of FIG. 4, the attachment anchor 204 may comprise a pivot socket 400 to interface with a pivot arm 210 of the chin bar 104, and a lock support 402 to interface with a biased latch arm 300 of the chin bar 104.

Many conventional helmets with removable chin bars interface with the chin bar through a linear motion, either requiring a user to align multiple connectors simultaneously, or using fewer connectors to simplify installation at the cost of strength. Advantageously, the helmet bodies 102 contemplated herein comprise attachment anchors 204 making use of pivot sockets configured to pivotally couple with the pivot arms 210 of a removable chin bar 104. In the context of the present description and the claims that follow, a pivot socket 400 may be any receiver or other structure that is configured to receive at least a portion of a pivot arm, and couple with the pivot arm in a releasable, pivoting fashion. As an option, the pivot socket 400 may be configured such that the coupling with a pivot arm is only releasable when the chin bar 104 is in a particular orientation with respect to the helmet body 102.

FIG. 4 shows a non-limiting example of a pivot socket 400. According to various embodiments, a pivot socket 400 may comprise a slot 404 that is reentrant, or narrows slightly before getting wider again. In some embodiments, the slot 404 may be described as having a bent keyhole shape. The pivot slot 400 may be configured to receive a pivot button 302 of a pivot arm 210. More specifically, the pivot slot 400 may comprise an open end 406 proximate the leading edge 202 of the helmet body opening 200, and a closed end 408, as shown in FIG. 4. The closed end 408 may be wider than the open end 406, and sized such that the closed end 408 may receive the stem 304 of a pivot button 302, but narrow enough to prevent the head 306 of the pivot button 302 from sliding out of the slot 404 except through the open end 406.

As shown, the pivot socket 400 is angled away from the face of the helmet wearer, such that the slot 404 forms an angle 418 with respect to the helmet body 102 that is approximately (e.g. within 30 degrees) equal to the insertion angle (e.g. the first angle 500 of FIG. 5A) for the pivot arm into the pivot socket. In some embodiments, the open end 406 of the pivot socket 400 is also facing away from the lock support 402.

When the stem 304 of the pivot button 302 is inside the closed end 408 of the reentrant slot 404 of the pivot socket 400, the pivot arm 210 is pivotally coupled to the pivot socket 400, and releasable only when the chin bar 104 is pivoted to form an angle with respect to the helmet body 102 of approximately the angle of the slot 404. In other embodiments, other releasable pivot systems may be employed. For example, in one embodiment, the stem of the pivot button may be shaped such that when turned a certain way it is narrow enough to enter a pivot socket, but then trapped when pivoting after engagement. The formation of an initial pivoting coupling through the pivot sockets 400 and the pivot arms 210 will be discussed in greater detail with respect to FIGS. 5A-C.

As shown, the attachment anchor 204 further comprises a lock support 402 to interface with a locking mechanism 208 of the chin bar 104. According to some embodiments, including the non-limiting example shown in FIG. 4, the lock support 402 may be shaped to receive and trap the end of a biased latch arm 300 when the chin bar 104 is fully engaged. In other embodiments, the locking mechanism 208 and lock support 402 may comprise any other locking method known in the art.

According to various embodiments, including the non-limiting example of FIG. 4, each locking mechanism 208 of a chin bar 104 comprises a biased latch arm 300 having a barbed end 412 that comprises a front 414 and a back 416. The end of the biased latch arm 300 is described as "barbed" as it is configured to easily slide past the lock support 402 yet, once past, can only be disengaged by moving the latch arm 300 against a bias 410. In some embodiments, this is accomplished through a release button 214, as previously discussed. The latch arm 300 may be biased through a bias element such as a spring, or through the elastic deformation of the arm 300 itself, or through any other biasing means known in the art.

In some embodiments, the front 414 of the barbed end 412 may be sloped such that when the barbed end 412 is pressed into the lock support 402 as the chin bar 104 is pivoted into a locked position, the biased latch arm 300 is deflected contrary to the bias 410 until the barbed end 412 is past the lock support 402, after which the back 416 of the barbed end 412 engages with the lock support 402. In other embodiments, the lock support 402 may be sloped or otherwise shaped to accomplish this, while in still other embodiments, both the front 414 and the lock support 402 may be sloped or contoured to facilitate passing the barbed end 412 of the biased latch arm 300 past the lock support 402.

Figure 5A:
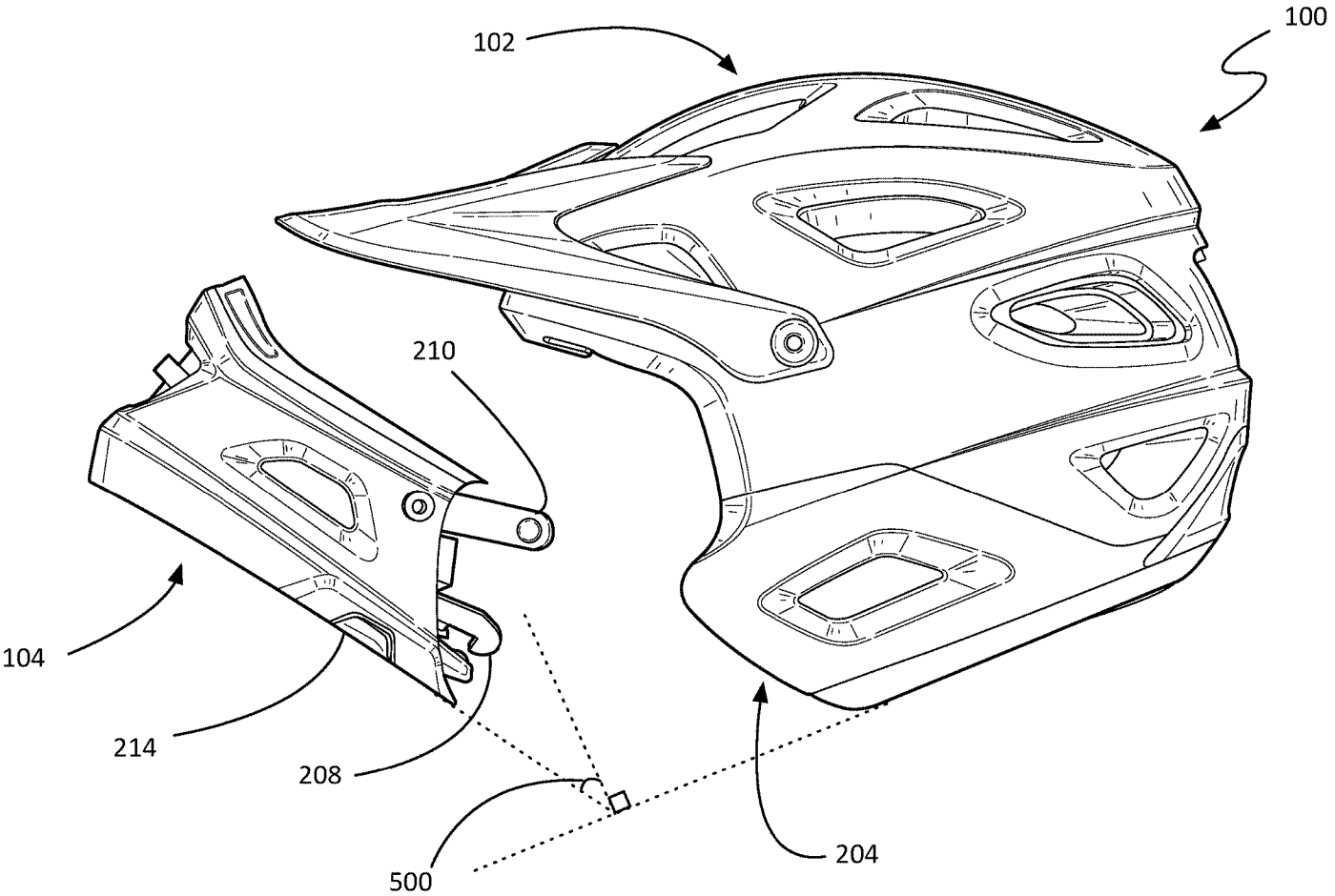
FIG. 5A is a side view of a chin bar being coupled to a helmet body.

FIGS. 5A-D show the steps of attaching a removable chin bar 104 to a helmet body 102, according to a non-limiting embodiment. FIG. 5A shows the pivot arms 210 being inserted into the attachment anchors 204 such that the pivot button 302 engages the pivot socket 400. As previously described, according to some embodiments, the pivot sockets 400 of the attachment anchor may be shaped such that insertion of the pivot button 302 may only be accomplished when the chin bar 104 is held at a first angle 500, or within an angle range (e.g. within 30 degrees, etc.), as shown in FIG. 5A.

Figure 5B:
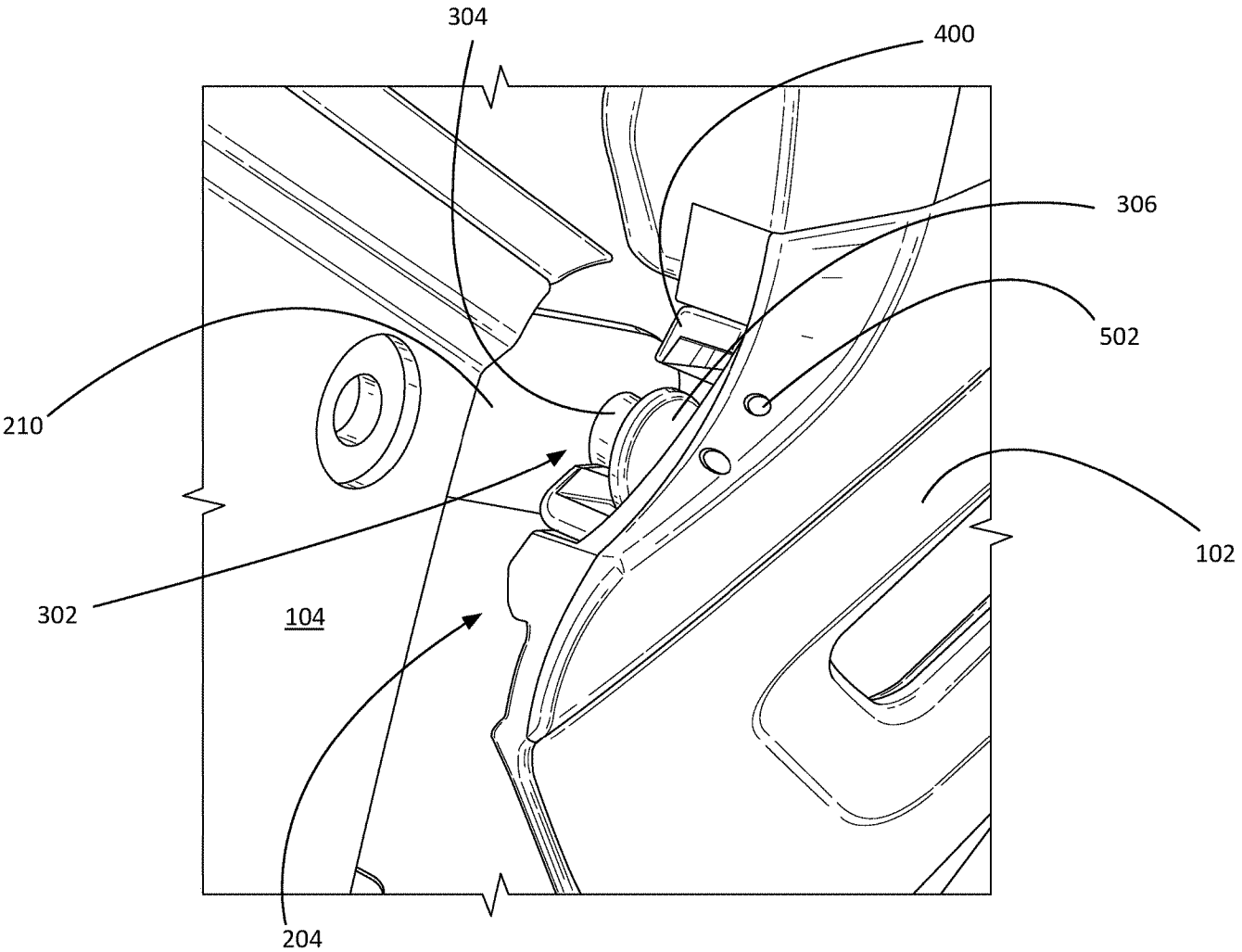
FIG. 5B is a close-up view of a pivot button being inserted into a pivot socket.

FIG. 5B shows a close-up view of a pivot button 302 of a pivot arm 210 engaging with a pivot socket 400 of an attachment anchor 204. In various embodiments, a helmet body 102 and a removable chin bar 102 may comprise features to facilitate installation and removal of the chin bar 104 while the helmet 100 is being worn. For example, in the non-limiting embodiment shown in FIG. 5B, the outer surface 106 of helmet body 102 may comprise one or more tactile guides 502 next to the open end 406 of the pivot socket 400. Tactile guides 502 may aid the user in locating the point of insertion of the pivot button 302 through touch, allowing them to install the chin bar 104 without removing the helmet 100. Examples of tactile guides 502 include, but are not limited to, bumps, textures, a different material, an indentation, or a protrusion. In another embodiment, a helmet body 102 and removable chin bar 104 may employ magnets to guide a pivot arm 210 into the opening of the pivot socket 400. For example, the pivot button 302 may be configured to have a magnetic attraction with the back surface of the pivot socket 400 (e.g. the surface that does not comprise the slot 404).

Once the head 306 of the pivot button 302 has been inserted into the open end 406 of the pivot socket 400, the chin bar 104 is pushed toward the helmet body 102 along the first angle 500 until the stem 304 of the pivot button 302 has engaged the closed end 408 of the reentrant slot 404 of the pivot socket 400. Once the stem 304 is engaged, the chin bar 104 is able to pivot between the first angle 500 and a second angle 504 (with respect to the helmet body 102).

Figure 5C:
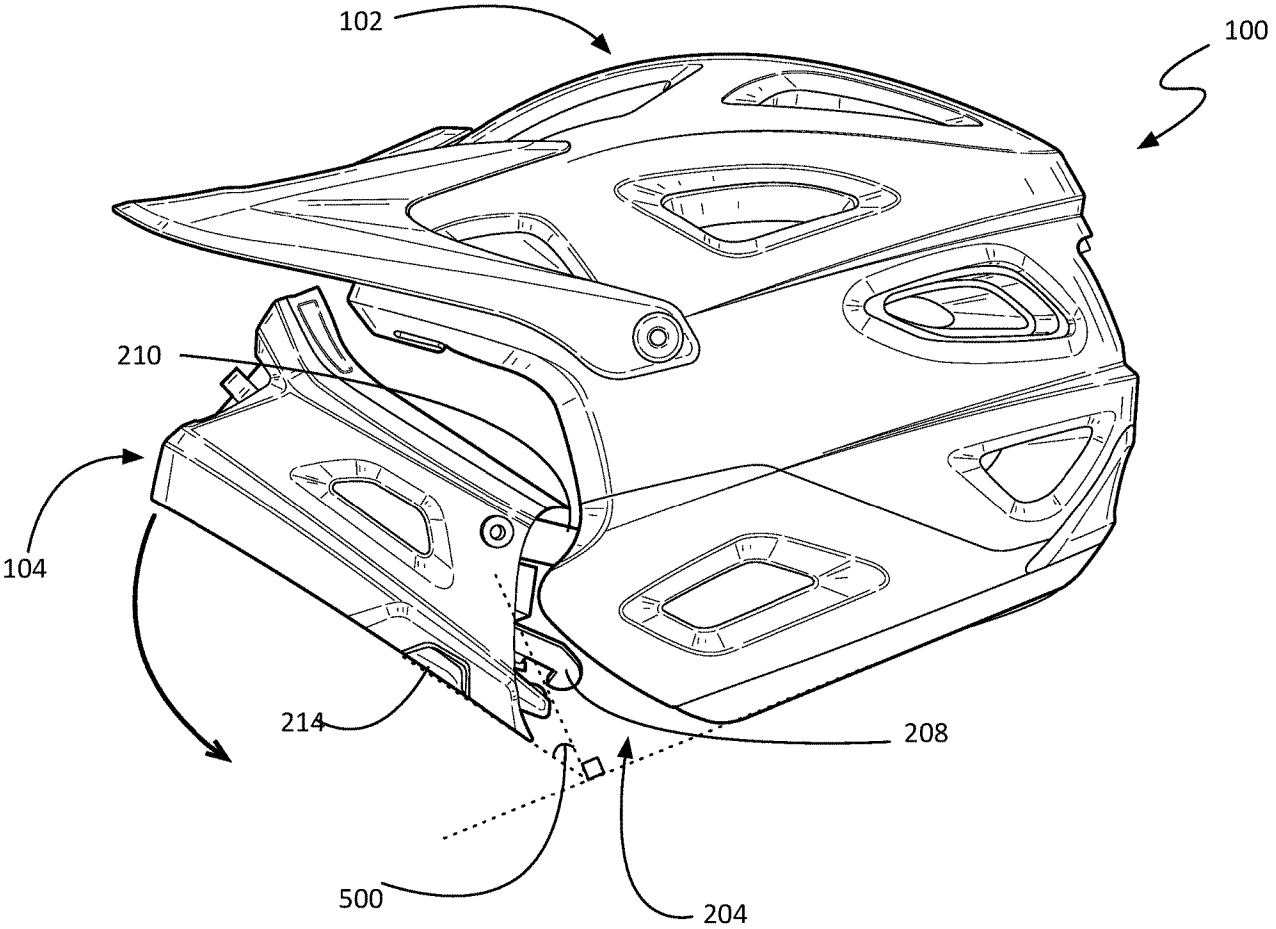
FIG. 5C is a side view of a chin bar pivotally coupled to a helmet body through a pivot arm.

After the pivot button 302 has fully engaged the pivot socket 400, the chin bar 104 may be swung or pivoted into a locked position, as shown in FIG. 5C. This is advantageous over conventional helmets with removable chin bars, which rely on a linear movement, making it difficult to align the various attachment mechanisms. Initially inserting the pivot arms 210 and engaging the pivot sockets 400 aligns the chin bar 104 so it can be pivoted into place and the remaining elements of the connectors 310 may engage with the attachment anchors 204 without requiring any alignment adjustments.

Figure 5D:
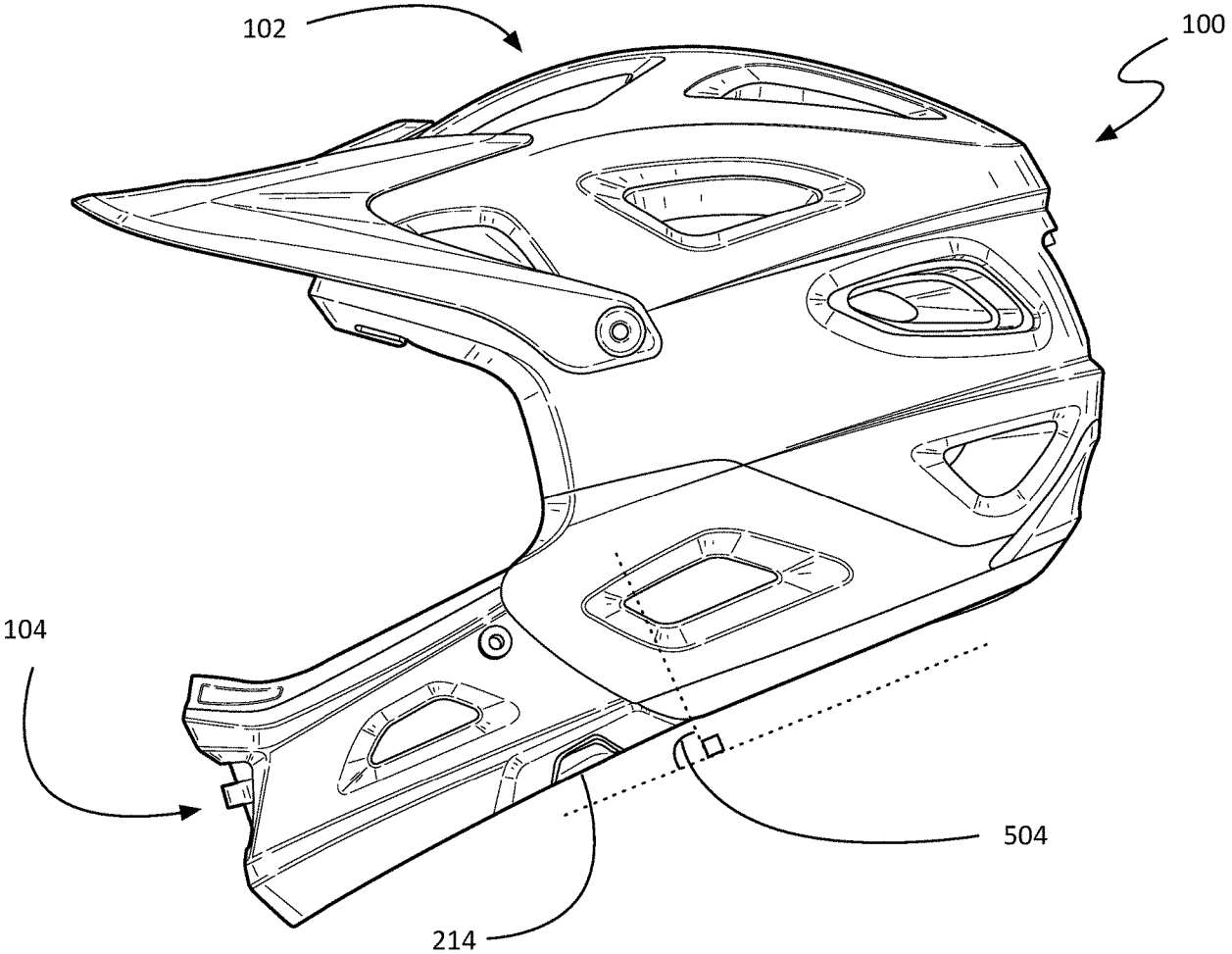
FIG. 5D is a side view of a chin bar coupled to a helmet body.

FIG. 5D shows the chin bar 104 in a locked position, where the chin bar 104 is at a second angle 504 with respect to the helmet body 102. According to various embodiments, the chin bar 104 may be released by disengaging the locking mechanisms 208, such as the biased latch arm 300. For example, in the non-limiting embodiment depicted in FIG. 5D, the biased latch arms 300 may be raised against their bias, and the chin bar 104 released to pivot upward to the first angle 500, by pressing the release buttons 214 located on both sides of the chin bar 104.

Figure 6:
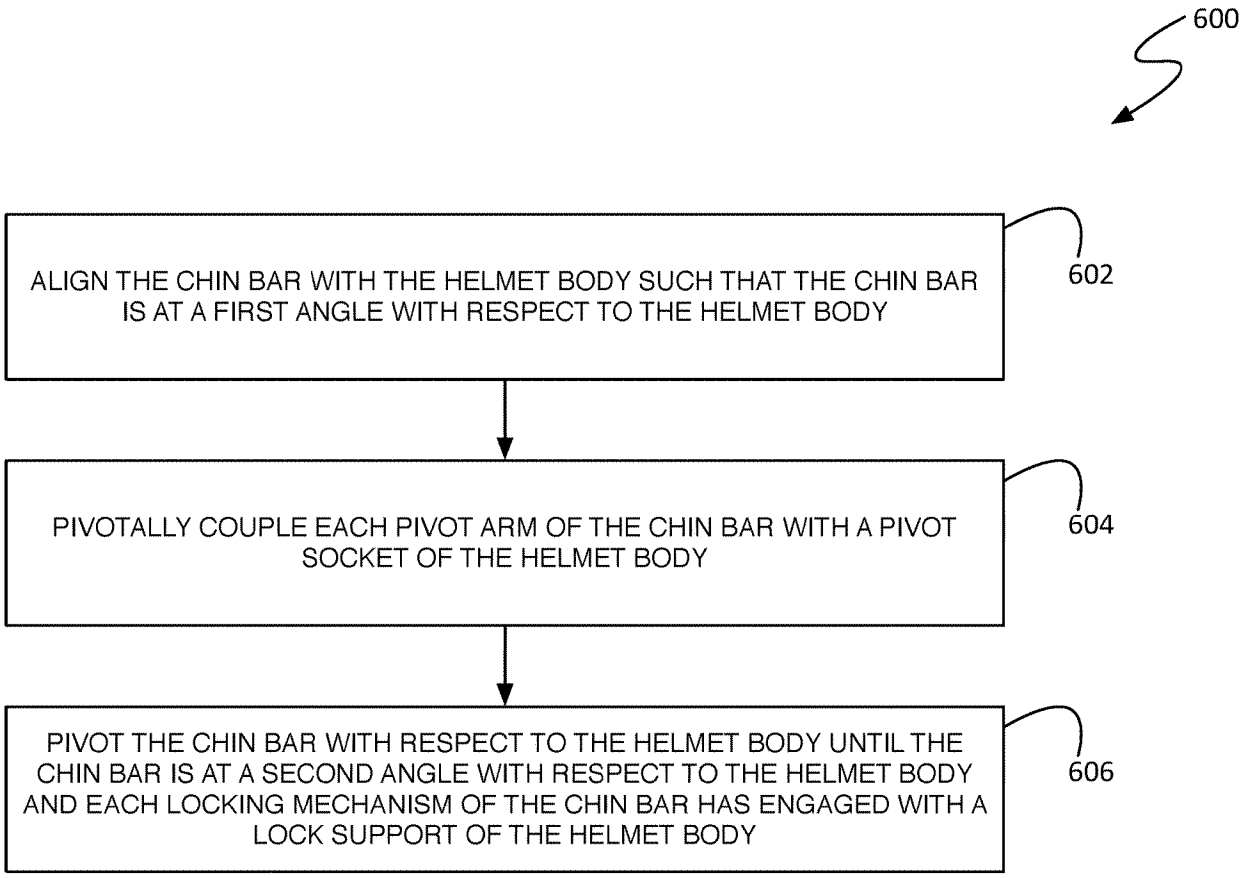
FIG. 6 is a flow diagram showing a method for attaching a removable chin bar to a helmet body.

FIG. 6 illustrates an implementation of a method 600 for attaching a removable chin bar 104 to a helmet body 102, according to various embodiments. As shown, the method includes aligning the chin bar 104 with the helmet body 102 such that the chin bar 104 is at a first angle 500 with respect to the helmet body 102 (step 602), and then pivotally coupling a pivot arm 210 of each end 206 of the chin bar 104 with a pivot socket 400 of each of two attachment anchors 204 located opposite each other and proximate a leading edge 202 of an opening 200 of the helmet body 102. In some embodiments, this pivotal coupling may be accomplished by engaging the pivot sockets 400 with pivot buttons 302 located near the end of each pivot arm 210, as detailed above.

Finally, the method 600 includes pivoting the chin bar 104 with respect to the helmet body 102 until the chin bar 104 is at a second angle 504 with respect to the helmet body 102 and each locking mechanism 208 of the chin bar 104 has engaged with a nearby lock support 402 of each attachment anchor 204 of the helmet body 102. As previously described, in some embodiments, the locking mechanism 208 may be a biased latch arm 300 with a barbed end 412.

Where the above examples, embodiments and implementations reference examples, it should be understood by those of ordinary skill in the art that other helmet and manufacturing devices and examples could be intermixed or substituted with those provided. In places where the description above refers to particular embodiments of helmets with removable chin bars, it should be readily apparent that a number of modifications may be made without departing from the spirit thereof and that these embodiments and implementations may be applied to other to helmets as well. Accordingly, the disclosed subject matter is intended to embrace all such alterations, modifications and variations that fall within the spirit and scope of the disclosure and the knowledge of one of ordinary skill in the art.

What is claimed is:

1. A helmet, comprising: a helmet body comprising an opening and two attachment anchors located opposite each other proximate a leading edge of the opening, each attachment anchor comprising a pivot socket and a lock support; and a chin bar removably coupled to the helmet body, the chin bar comprising two opposing ends, each end releasably coupled to a different one of the two attachment anchors and comprising a locking mechanism engaged with the lock support of the different one of the two attachment anchors and a pivot arm releasably and pivotally coupled to the pivot socket of the different one of the two attachment anchors; wherein the chin bar is pivotable between a first angle and a second angle with respect to the helmet body, and the pivot arms are releasable from the pivot sockets of the helmet body, only while the locking mechanisms of the chin bar are disengaged from the lock supports of the helmet body; wherein each pivot arm of the chin bar comprises a socket of each of the two attachment anchors of the helmet body comprises a reentrant slot having an open end wider than a closed end, the open end proximate the leading edge of the opening of the helmet body, and the closed end sized to receive the stem of the pivot button while being smaller than the head of the pivot button, and wherein the pivot arm is releasably and pivotally coupled to the pivot socket when the stem of the pivot button is inside the closed end of the reentrant slot of the pivot socket.

2. The helmet of claim 1, wherein each locking mechanism of the chin bar comprises a biased latch arm having a barbed end, the barbed end having a front and a back, at least one of the front of each barbed end and the lock support of each of the two attachment anchors is sloped such that when the front is pressed against the lock support, the latch arm is deflected contrary to a bias, to allow the barbed end past the lock support such that the back may engage with the lock support, and wherein each locking mechanism further comprises a release button configured to move the latch arm of the locking mechanism against the bias sufficient to disengage the back of the barbed end from the lock support.

3. The helmet of claim 1, wherein the two opposing ends of the chin bar each further comprise at least one tab configured to mate with a portion of the adjacent attachment anchor while the chin bar is coupled to the helmet body.

4. The helmet of claim 1, wherein the helmet body comprises an outer surface having at least one tactile guide on the outer surface proximate each pivot socket of the helmet body.

5. The helmet of claim 1, wherein the two attachment anchors are integral with an outer shell of the helmet body.

6. The helmet of claim 1, wherein the two attachment anchors are in-molded into an energy-absorbing material of the helmet body.

7. The helmet of claim 1, wherein the helmet body further comprises an outer surface, the chin bar comprises an outer surface, and the outer surface of the helmet body is flush with the outer surface of the chin bar proximate the two attachment anchors.

8. The helmet of claim 1, wherein, for each of the two attachment anchors, the leading edge of the opening proximate the attachment anchor is in fluid communication with an interior cavity of the helmet body through the attachment anchor.

9. A helmet, comprising:

a helmet body comprising an opening and two attachment anchors located opposite each other proximate a leading edge of the opening, each attachment anchor comprising a pivot socket and a lock support; and a chin bar removably coupled to the helmet body, the chin bar comprising two opposing ends, each end releasably coupled to a different one of the two attachment anchors and comprising a locking mechanism engaged with the lock support of the different one of the two attachment anchors and a pivot arm releasably and pivotally coupled to the pivot socket of the different one of the two attachment anchor;

wherein the chin bar is pivotable between a first angle and a second angle with respect to the helmet body, and the pivot arms are releasable from the pivot sockets of the helmet body, only while the locking mechanisms of the chin bar are disengaged from the lock supports of the helmet body and the chin bar is oriented at approximately the first angle with respect to the helmet body;

wherein each locking mechanism of the chin bar comprises a biased latch arm having a barbed end, the barbed end having a front and a back, at least one of the front and the lock support of each of the two attachment anchors is sloped such that when the front is pressed against the lock support, the latch arm is deflected contrary to a bias, to allow the barbed end past the lock support such that the back may engage with the lock support, and wherein each locking mechanism further comprises a release button configured to move the latch arm of the locking mechanism against the bias sufficient to disengage the back of the barbed end from the lock support; and wherein each pivot arm of the chin bar comprises a pivot button having a stem and a head wider than the stem, wherein the pivot socket of each of the two attachment anchors of the helmet body comprises a reentrant slot having an open end wider than a closed end, the open end proximate the leading edge of the opening of the helmet body and facing away from the lock support of the same attachment anchor at an angle with respect to the helmet body that is approximately equal to the first angle, and the closed end sized to receive the stem of the pivot button while being smaller than the head of the pivot button, and wherein the pivot arm is releasably and pivotally coupled to the pivot socket when the stem of the pivot button is inside the closed end of the reentrant slot of the pivot socket.

10. The helmet of claim 9, wherein the two opposing ends of the chin bar each further comprise at least one tab configured to mate with a portion of the adjacent attachment anchor while the chin bar is coupled to the helmet body.

11. The helmet of claim 9, wherein the helmet body comprises an outer surface having at least one tactile guide on the outer surface proximate each pivot socket of the helmet body.

12. The helmet of claim 9, wherein the two attachment anchors are integral with an outer shell of the helmet body.

13. The helmet of claim 9, wherein the helmet body further comprises an outer surface, the chin bar comprises an outer surface, and the outer surface of the helmet body is flush with the outer surface of the chin bar proximate the two attachment anchors.

14. The helmet of claim 9, wherein, for each of the two attachment anchors, the leading edge of the opening proximate the attachment anchor is in fluid communication with an interior cavity of the helmet body through the attachment anchor.

15. The helmet of claim 9, wherein the pivot arms and locking mechanisms of the chin bar and the pivot sockets and lock supports of the helmet body are positioned such that when the pivot arms of the chin bar are pivotally coupled to the pivot sockets of the helmet body, each locking mechanism of the chin bar is aligned with a different one of the two lock supports of the helmet body.

16. The helmet of claim 9, wherein each end of the chin bar further comprises a leading edge that is mated with the leading edge of the opening of the helmet body when the chin bar is removably coupled to the helmet body through the pivot arms and locking mechanisms of the chin bar.

* * * * *